US008417440B2

(12) United States Patent
Takahashi

(10) Patent No.: US 8,417,440 B2
(45) Date of Patent: Apr. 9, 2013

(54) HYDRAULIC CONTROL DEVICE FOR INTERNAL COMBUSTION ENGINE

(75) Inventor: Katsuaki Takahashi, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 12/808,298

(22) PCT Filed: Mar. 31, 2009

(86) PCT No.: PCT/JP2009/056624

§ 371 (c)(1),
(2), (4) Date: Jun. 15, 2010

(87) PCT Pub. No.: WO2010/113245

PCT Pub. Date: Oct. 7, 2010

(65) Prior Publication Data

US 2011/0041798 A1 Feb. 24, 2011

(51) Int. Cl.

| | |
|---|---|
| ***G06F 19/00*** | (2011.01) |
| ***F01M 11/10*** | (2006.01) |
| ***F01M 1/18*** | (2006.01) |
| ***G01M 15/00*** | (2006.01) |

(52) U.S. Cl. .... 701/114; 123/196 S; 184/6.4; 73/114.57

(58) Field of Classification Search ..... 123/196 S, 123/198 D; 701/102, 114; 184/6.4, 6.5; 73/114.56, 114.57; 440/84, 88 L See application file for complete search history.

(56) References Cited

U.S. PATENT DOCUMENTS

| | | | | |
|---|---|---|---|---|
| 4,940,114 | A * | 7/1990 | Albrecht | 184/6.3 |
| 6,614,345 | B2 | 9/2003 | Kimata et al. | |
| 7,140,934 | B2 * | 11/2006 | Hoi | 440/88 L |
| 7,201,622 | B2 * | 4/2007 | Hoi | 440/52 |
| 7,219,643 | B2 * | 5/2007 | Hoi et al. | 123/196 AB |
| 7,219,644 | B2 * | 5/2007 | Hoi | 123/196 AB |

FOREIGN PATENT DOCUMENTS

| | | |
|---|---|---|
| JP | 62 248812 | 10/1987 |
| JP | 4 17708 | 1/1992 |
| JP | 5 26023 | 2/1993 |
| JP | 6-101439 | 4/1994 |
| JP | 8-312436 | 11/1996 |
| JP | 2000-54817 | 2/2000 |
| JP | 2000-328916 | 11/2000 |
| JP | 2002-147214 | 5/2002 |
| JP | 2007 107485 | 4/2007 |
| JP | 2008-286021 | 11/2008 |

OTHER PUBLICATIONS

English translation of the International Preliminary Report on Patentability issued Nov. 15, 2011, in PCT/JP2009/056624.

Notice of Allowance issued Mar. 29, 2011, in Japan Patent Application No. 2008-291911.

International Search Report issued Jun. 9, 2009 in PCT/JP2009/056624.

* cited by examiner

*Primary Examiner* — Willis R Wolfe, Jr.

(74) *Attorney, Agent, or Firm* — Oblon, Spivak, McClelland, Maier & Neustadt, L.L.P.

(57) ABSTRACT

A hydraulic control device for an internal combustion engine having a pressure level switch mechanism that switches the pressure level of the oil supplied to components of the engine between a high pressure level and a low pressure level is provided. The hydraulic control device has a detecting section and a determining section. The determining section outputs a command signal instructing to switch the pressure level of the oil to the high pressure level to the pressure level switch mechanism and determines that the pressure level switch mechanism has a malfunction on condition that, after the command signal has been output, the pressure of the oil detected by the detecting section is smaller than a high-pressure-level switching malfunction determination value.

10 Claims, 7 Drawing Sheets

HYDRAULIC CONTROL DEVICE FOR INTERNAL COMBUSTION ENGINE

FIELD OF THE INVENTION

The present invention relates to a hydraulic control device for an internal combustion engine.

BACKGROUND OF THE INVENTION

For example, as described in Patent Document 1, a typical hydraulic control device for an internal combustion engine includes a relief valve, which permits some oil to escape into a relief passage when the pressure of the oil discharged by an oil pump become greater than or equal to a predetermined valve opening pressure. In this manner, the pressure of oil supplied to components of the engine is prevented from rising excessively.

A hydraulic control device for an internal combustion engine having a switch valve, which switches the valve opening pressure of the relief valve between, for example, two levels, has been developed. In the hydraulic control device, the switch valve switches the level of the pressure of the oil supplied to the components of the engine between a high pressure level and a low pressure level. Specifically, when, for example, the engine is currently in such an operating state that it is unnecessary to raise the pressure of oil supplied to the components of the engine, the pressure of the oil is switched to the low pressure level, which improves the fuel efficiency.

However, in the hydraulic control device having the switch valve, when the relief valve or the switch valve has a malfunction in which the valve cannot regulate the pressure of oil to the high pressure level, the pressure of the oil supplied to the components of the engine drops. In this case, the engine may not be operated stably when the engine is in such an operating state that the oil under high pressure is necessary. When the relief valve or the switch valve has a malfunction in which the valve cannot switch the pressure of the oil to the low pressure level, the pressure of the oil supplied to the engine components rises excessively, which reduces the fuel efficiency.

This problem also occurs in other hydraulic control devices than the hydraulic control device having the relief valve and the switch valve. That is, a similar problem is caused in any hydraulic control device for an internal combustion engine having a pressure level switch mechanism, which switches the pressure of oil supplied to components of the engine between a high pressure level and a low pressure level.

Patent Document 1: Japanese Laid-Open Patent Publication No. 2007-107485

SUMMARY OF THE INVENTION

Accordingly, it is an objective of the present invention to provide a hydraulic control device for an internal combustion engine capable of accurately determining whether a pressure level switch mechanism has a malfunction.

To achieve the foregoing objective and in accordance with a first aspect of the present invention, a hydraulic control device for an internal combustion engine is provided. The device has a pressure level switch mechanism that switches a pressure level of oil supplied to components of the engine between a high pressure level and a low pressure level. The hydraulic control device includes a detecting section and a determining section. The detecting section detects the pressure of the oil that has been regulated by the pressure level switch mechanism. The determining section outputs a command signal instructing to switch the pressure level of the oil to the high pressure level to the pressure level switch mechanism and determines that the pressure level switch mechanism has a malfunction on condition that, after the command signal has been output, the pressure of the oil detected by the detecting section is smaller than a high-pressure-level switching malfunction determination value. The high-pressure-level switching malfunction determination value is set to a value between a value that is expected when the oil pressure is at the high pressure level in the engine operating state at the time of the determination and a value that is expected when the oil pressure is at the low pressure level in the engine operating state at the time of the determination.

In accordance with a second aspect of the present invention, a hydraulic control device for an internal combustion engine is provided. The device has a pressure level switch mechanism that switches a pressure level of oil supplied to components of the engine between a high pressure level and a low pressure level. The hydraulic control device includes a detecting section and a determining section. The detecting section detects the pressure of the oil that has been regulated by the pressure level switch mechanism. The determining section outputs a command signal instructing to switch the pressure level of the oil to the low pressure level to the pressure level switch mechanism and determines that the pressure level switch mechanism has a malfunction on condition that, after the command signal has been output, the pressure of the oil detected by the detecting section is greater than a low-pressure-level switching malfunction determination value. The low-pressure-level switching malfunction determination value is set to a value between a value that is expected when the oil pressure is at the high pressure level in the engine operating state at the time of the determination and a value that is expected when the oil pressure is at the low pressure level in the engine operating state at the time of the determination.

BRIEF DESCRIPTION OF THE DRAWINGS

FIG. 3(*b*) is a cross-sectional view showing the pressure level switch mechanism of FIG. 2 at the time when the pressure level of oil is set to a high pressure level;

DETAILED DESCRIPTION OF PREFERRED EMBODIMENTS

A hydraulic control device for an internal combustion engine according to one embodiment of the present invention will now be described with reference to FIGS. 1 to 9.

Figure 1:
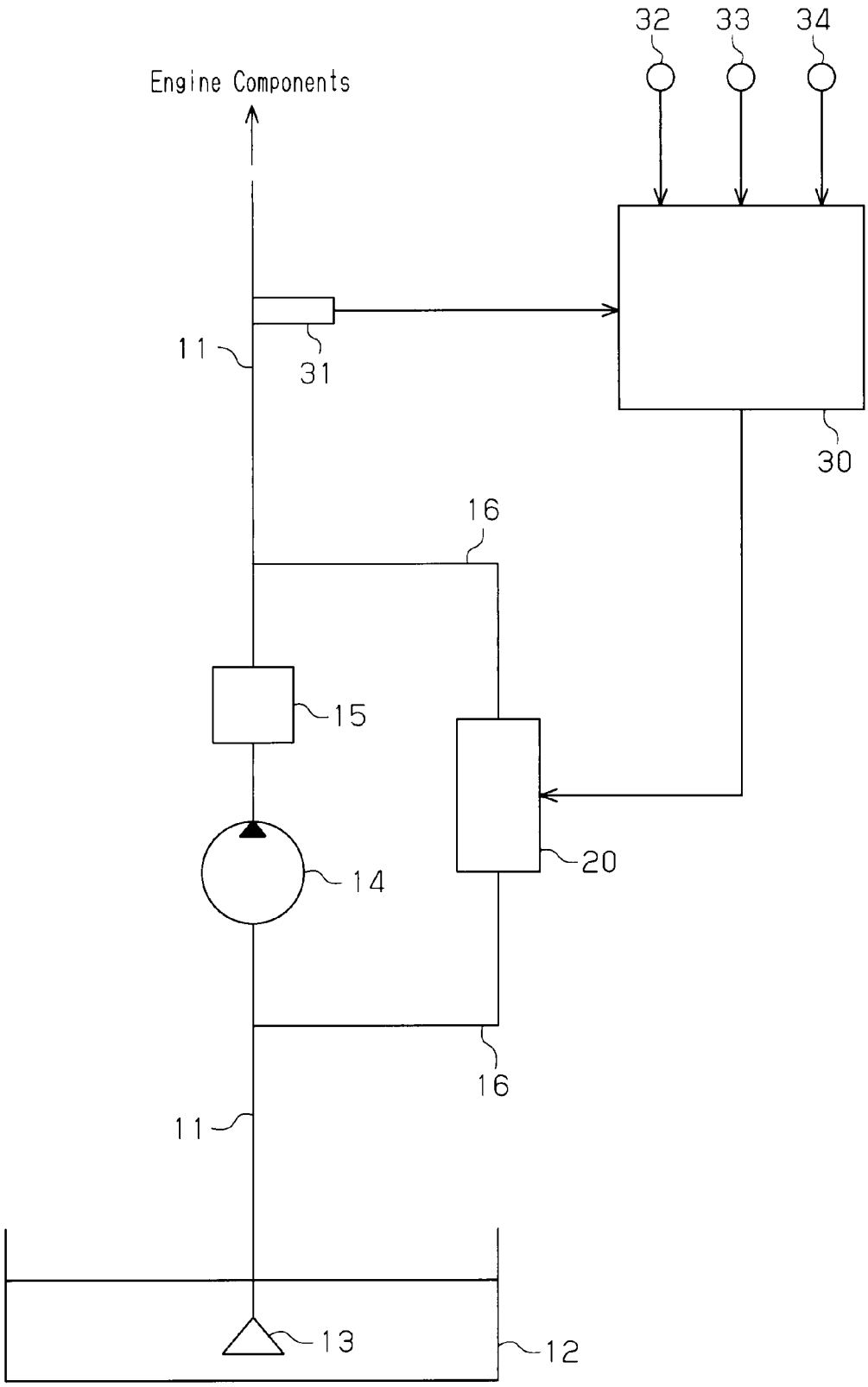
FIG. 1 is a diagram schematically showing a hydraulic control device for an internal combustion engine according to one embodiment of the present invention.

As illustrated in FIG. 1, the engine includes a main supply passage 11 through which oil retained in an oil pan 12 is supplied to components of the engine. An engine-driven oil pump 14, which selectively draws and discharges the oil, is provided in the main supply passage 11. An oil strainer 13, which filters out comparatively large impurities from the oil, is arranged at the upstream end of the main supply passage 11, that is, at the end corresponding to the oil pan 12. An oil filter 15, which filters out comparatively small impurities from the oil, is provided in a portion of the main supply passage 11 downstream from the oil pump 14. When the engine is operated and the oil pump 14 is actuated, oil is drawn from the oil pan 12 to the oil pump 14 through the main supply passage 11 and then sent to a downstream portion of the main supply passage 11. After having been discharged by the oil pump 14, the oil is fed to components of the engine (for example, various hydraulic pressure driven devices driven by the pressure of oil, a piston jet mechanism that cools a piston for obtaining engine output by ejecting the oil to the piston, and lubricated portions of the engine).

A relief passage 16 is connected to the main supply passage 11. Through the relief passage 16, a portion of the main supply passage 11 downstream from the oil pump 14 communicates with a portion of the main supply passage 11 upstream from the oil pump 14. Specifically, an end of the relief passage 16 is connected to the main supply passage 11 at a position downstream from the oil filter 15. The other end of the relief passage 16 is connected to the main supply passage 11 at a position between the oil pump 14 and the oil strainer 13. A pressure level switch mechanism 20, which switches the pressure of the oil supplied to the engine components between a high pressure level and a low pressure level, is provided in the relief passage 16. The pressure level switch mechanism 20 is controlled by an electronic control unit 30 serving as a determining section.

The electronic control unit 30 receives output signals of various sensors, such as an engine speed sensor 32 for detecting an engine speed NE, a coolant temperature sensor 33 for detecting the temperature of the engine coolant (hereinafter, referred to as a coolant temperature THW), an intake air amount sensor 34 for detecting an intake air amount GA, and an oil pressure sensor 31 for detecting the pressure of oil supplied to the components of the engine (hereinafter, referred to as an oil pressure Ps). The oil pressure sensor 31, which serves as a detecting section, is arranged in the main supply passage 11. The electronic control unit 30 determines the engine operating state based on the output signals and controls the engine including the pressure level switch mechanism 20 based on the determined engine operating state.

The configuration of the pressure level switch mechanism 20 will hereafter be described in detail with reference to FIG. 2.

Figure 2:
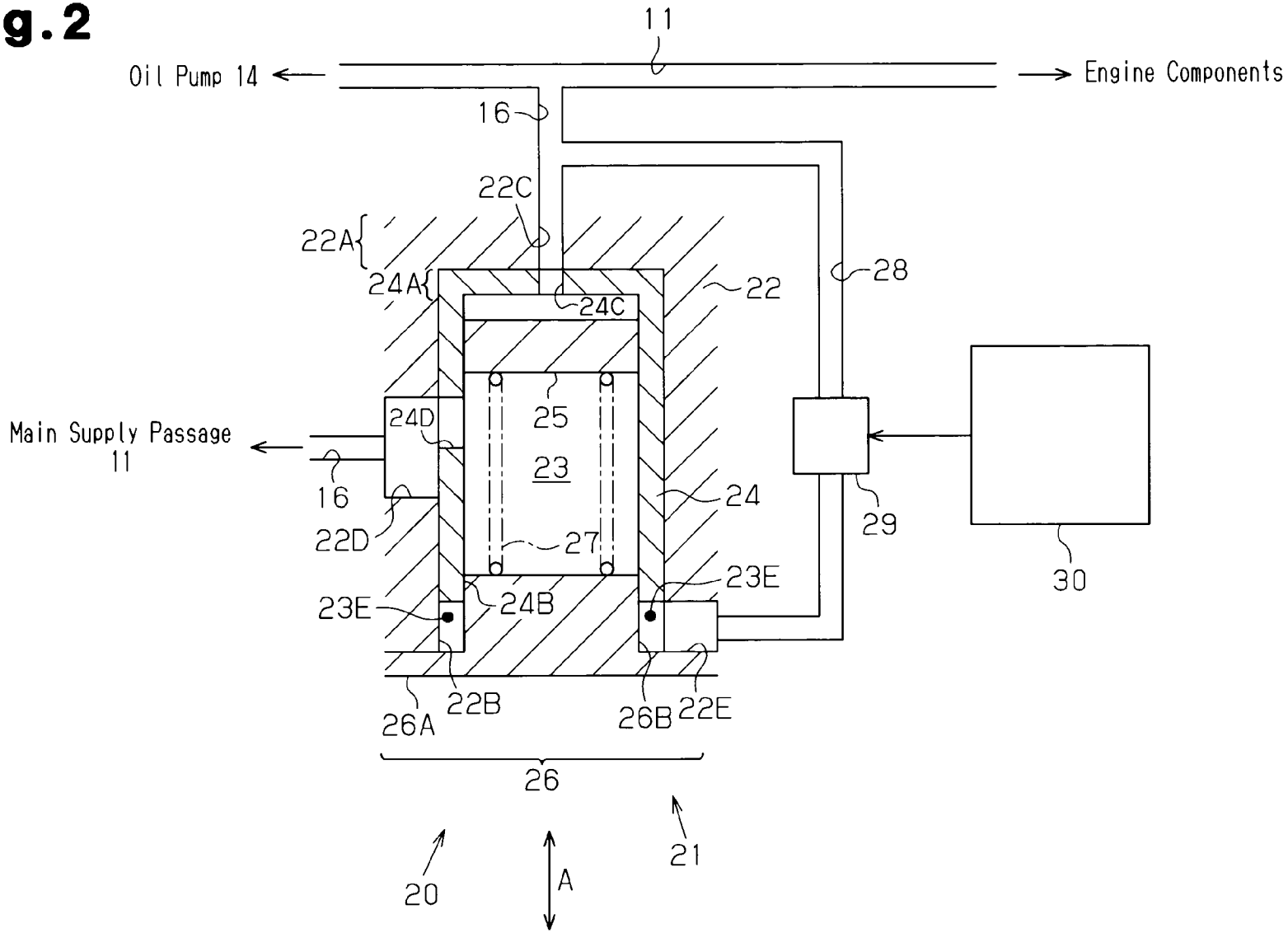
FIG. 2 is a cross-sectional view showing a pressure level switch mechanism of the hydraulic control device illustrated in FIG. 1.

With reference to FIG. 2, the pressure level switch mechanism 20 has a relief valve 21 and a switch valve 29. The relief valve 21 opens when the pressure of the oil discharged by the oil pump 14 becomes greater than or equal to a predetermined valve opening pressure Prrf. The switch valve 29, which serves as a switching section, switches the valve opening pressure Prrf between a first pressure Prrf1 corresponding to the low pressure level and a second pressure Prrf2 corresponding to the high pressure level. The second pressure Prrf2 is set to a value greater than the first pressure Prrf1.

The relief valve 21 is arranged in the relief passage 16 and includes a cylindrical housing 22 having a bottom portion 22A at an end, a tubular movable member 24 having a bottom portion 24A at an end, and a columnar valve body 25. The movable member 24 is received in an accommodation chamber 23, which is the interior of the housing 22, and movable in the axial direction A of the housing 22. The valve body 25 is accommodated in the movable member 24 so as to be movable in the axial direction A. The bottom portion 22A of the housing 22 and the bottom portion 24A of the movable member 24 are arranged at positions upstream in the relief passage 16, that is, at the side corresponding to the relief passage 16 connected to the main supply passage 11 at a position downstream from the oil pump 14. The relief valve 21 has a fixed member 26, which closes the opening of an end 22B of the housing 22 opposite to the bottom portion 22A. The relief valve 21 also includes an urging spring 27, which is arranged between the valve body 25 and the fixed member 26. The urging spring 27 urges the valve body 25 toward the bottom portion 24A (located upstream as viewed in FIG. 2) of the movable member 24.

The outer diameter of the movable member 24 is slightly smaller than the inner diameter of the housing 22. The outer diameter of the valve body 25 is slightly smaller than the inner diameter of the movable member 24. The fixed member 26 has a columnar large diameter portion 26A and a columnar small diameter portion 26B, which has a diameter smaller than the diameter of the large diameter portion 26A. The small diameter portion 26B is arranged coaxially with the large diameter portion 26A. An inner end surface of the large diameter portion 26A contacts an end surface of the end 22B of the housing 22 and a side surface (a circumferential surface) of the small diameter portion 26B contacts an inner circumferential surface of the end 24B of the movable member 24 opposite to the bottom portion 24A. An inlet-side through hole 22C is formed at the center of the bottom portion 22A of the housing 22. An inlet-side communication hole 24C, the diameter of which is equal to the diameter of the inlet-side through hole 22C, is formed at the center of the bottom portion 24A of the movable member 24. The through hole 22C and the communication hole 24C are part of the relief passage 16. The opening of the inlet-side through hole 22C in the accommodation chamber 23 corresponds to an inlet-side opening of the present invention.

An outlet-side through hole 22D, which extends through a side portion of the housing 22, is formed at the center of the side portion of the housing 22 in the axial direction A. An outlet-side communication hole 24D, which extends through a side portion of the movable member 24, is formed at a position of the side portion of the movable member 24 corresponding to the outlet-side through hole 22D. The length of the outlet-side communication hole 24D in the axial direction A is smaller than the length of the outlet-side through hole 22D in the axial direction A. The opening of the outlet-side through hole 22D in the accommodation chamber 23 corresponds to an outlet-side opening of the present invention. When the movable member 24 is arranged at a first position, at which the movable member 24 is closest to the bottom portion 22A of the housing 22 in the axial direction A, the portion of the outlet-side communication hole 24D corresponding to the bottom portion 24A coincides with the portion of the outlet-side through hole 22D corresponding to the bottom portion 22A (see FIG. 3(*a*)). When the movable member 24 is arranged at a second position, at which the movable member 24 is closest to the fixed member 26 in the axial direction A, the portion of the outlet-side communication hole 24D corresponding to the fixed member 26 coincides with the portion of the outlet-side through hole 22D corresponding to the fixed member 26 (see FIG. 3(*b*)).

The length of the movable member 24 in the axial direction A is smaller than the length of the accommodation chamber 23 in the axial direction A. A space 23E is thus defined by the end 24B of the movable member 24 and the large diameter portion 26A and the small diameter portion 26B of the fixed member 26. An introducing through hole 22E, which allows communication between the space 23E and the exterior, is formed at the end 22B of the housing 22. The portion of the relief passage 16 upstream from the inlet-side through hole 22C of the housing 22 and the introducing through hole 22E communicate with each other through an introduction passage 28. An electromagnetic switch valve 29, which switches whether to introduce the oil discharged by the oil pump 14 into the introducing through hole 22E is provided in the introduction passage 28. In the present embodiment, the switch valve 29 opens when power is supplied to the switch valve 29 and closes when the power supply to the switch valve 29 is stopped.

Operation of the pressure level switch mechanism 20 will hereafter be described with reference to FIG. 3.

Figure 3A:
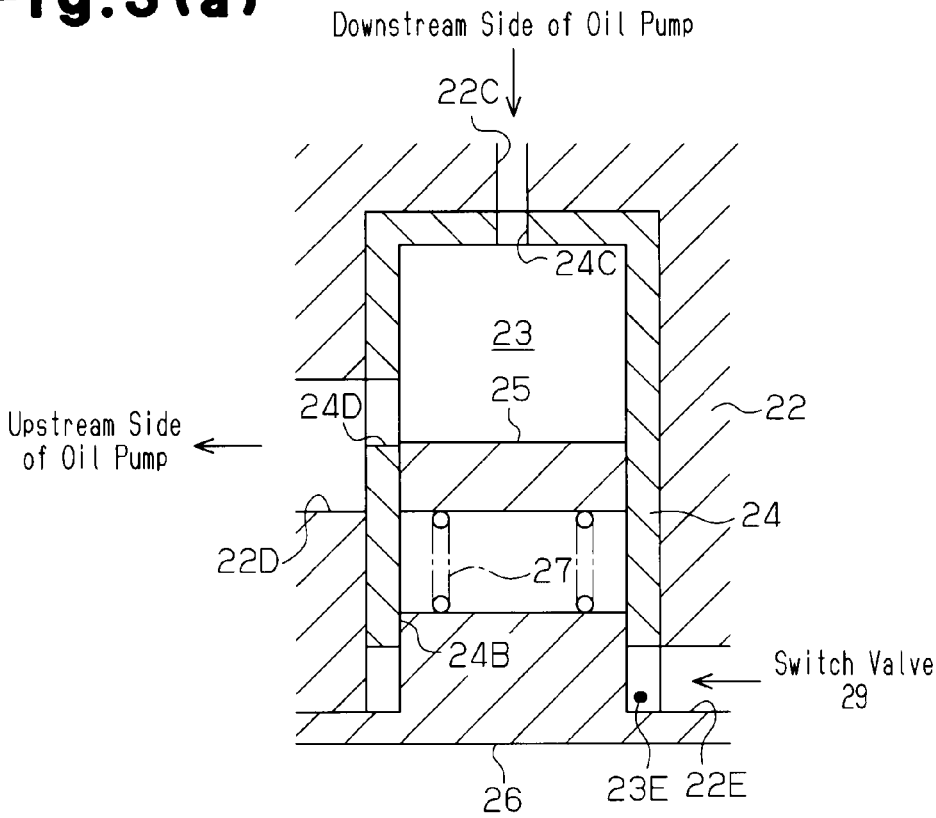
FIG. 3(*a*) is a cross-sectional view showing the pressure level switch mechanism of FIG. 2 at the time when the pressure level of oil is set to a low pressure level.
Figure 3B:
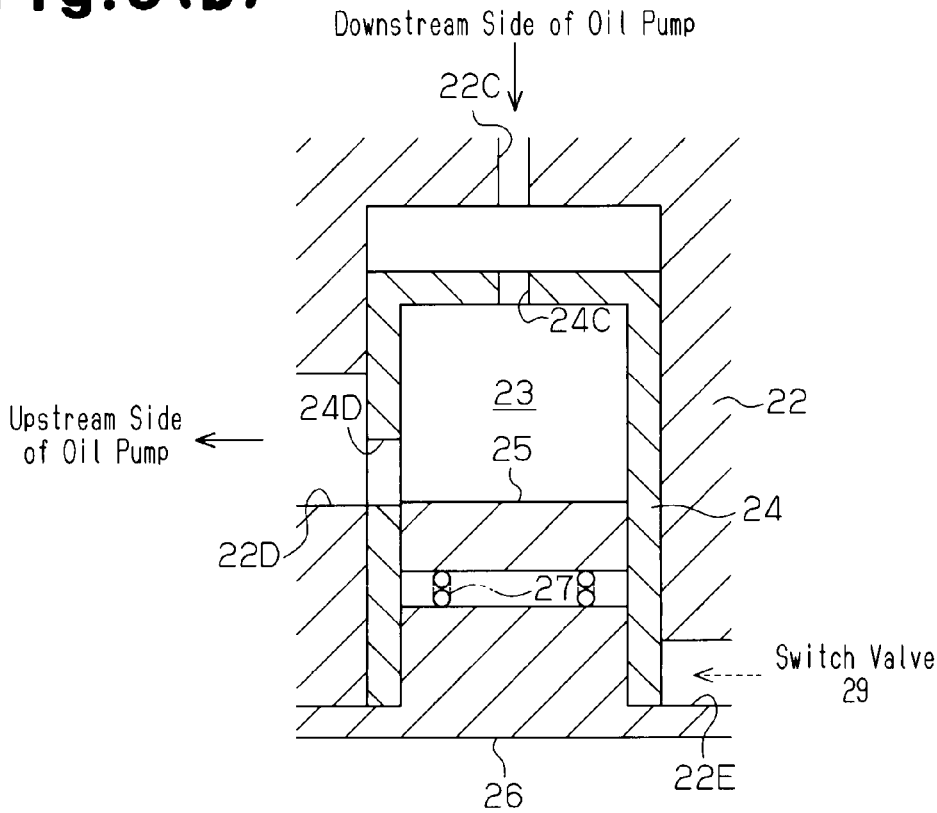

FIG. 3(*a*) shows a cross-sectional configuration of the pressure level switch mechanism 20 at the time when the pressure level of the oil is the low pressure level. FIG. 3(*b*) shows the cross sectional configuration of the pressure level switch mechanism 20 at the time when the pressure level of the oil is the high pressure level.

With reference to FIG. 3(*a*), when the switch valve 29 is open, the oil discharged by the oil pump 14 is introduced into the space 23E through the introduction passage 28 and the introducing through hole 22E. This raises the pressure of the oil in the space 23E, thus pressing and raising the movable member 24 toward the bottom portion 22A of the housing 22, that is, in a valve closing direction of the valve body 25. The movable member 24 is thus moved to the first position. Then, as the engine speed NE rises and the pressure of the oil sent from the oil pump 14 increases, the pressure of the oil applied to the valve body 25 in a valve opening direction becomes greater than or equal to the first pressure Prrf1. At this point, the valve body 25 is located at the position illustrated in FIG. 3(*a*) or a position below the illustrated position. In this state, the inlet-side through hole 22C, the inlet-side communication hole 24C, the accommodation chamber 23, the outlet-side communication hole 24D, and the outlet-side through hole 22D are all in a communicating state. This causes the excessive oil in the portion of the main supply passage 11 downstream from the oil pump 14 to escape into the portion of the main supply passage 11 upstream from the oil pump 14 through the relief passage 16. As a result, the pressure level of the oil supplied to the components of the engine is switched to the low pressure level.

When the switch valve 29 closes as illustrated in FIG. 3(*b*), introduction of the oil from the oil pump 14 to the space 23E through the introduction passage 28 and the introducing through hole 22E is prohibited. Accordingly, the force produced by the pressure of the oil that presses and raises the movable member 24 toward the bottom portion 22A of the housing 22, that is, in the valve closing direction of the valve body 25, becomes smaller than the force that acts to press and lower the movable member 24 toward the fixed member 26, that is, in the valve opening direction of the valve body 25. The movable member 24 is thus moved to the second position. Then, as the engine speed NE increases and the pressure of the oil discharged by the oil pump 14 rises, the pressure of the oil applied to the valve body 25 becomes greater than or equal to the second pressure Prrf2 (Prrf2>Prrf1). At this point, the valve body 25 is located at the position illustrated in FIG. 3(*b*) or a position below the illustrated position. In this state, the inlet-side through hole 22C, the inlet-side communication hole 24C, the accommodation chamber 23, the outlet-side communication hole 24D, and the outlet-side through hole 22D are all in a communicating state. This causes the excessive oil in the portion of the main supply passage 11 downstream from the oil pump 14 to escape into the portion of the main supply passage 11 upstream from the oil pump 14 through the relief passage 16. As a result, the pressure level of the oil fed to the components of the engine is switched to the high pressure level.

Next, an example of change of the oil pressure Ps at the time when the pressure level of the oil is switched from the low pressure level to the high pressure level in response to a rise in the engine speed NE will be described.

Figure 4:
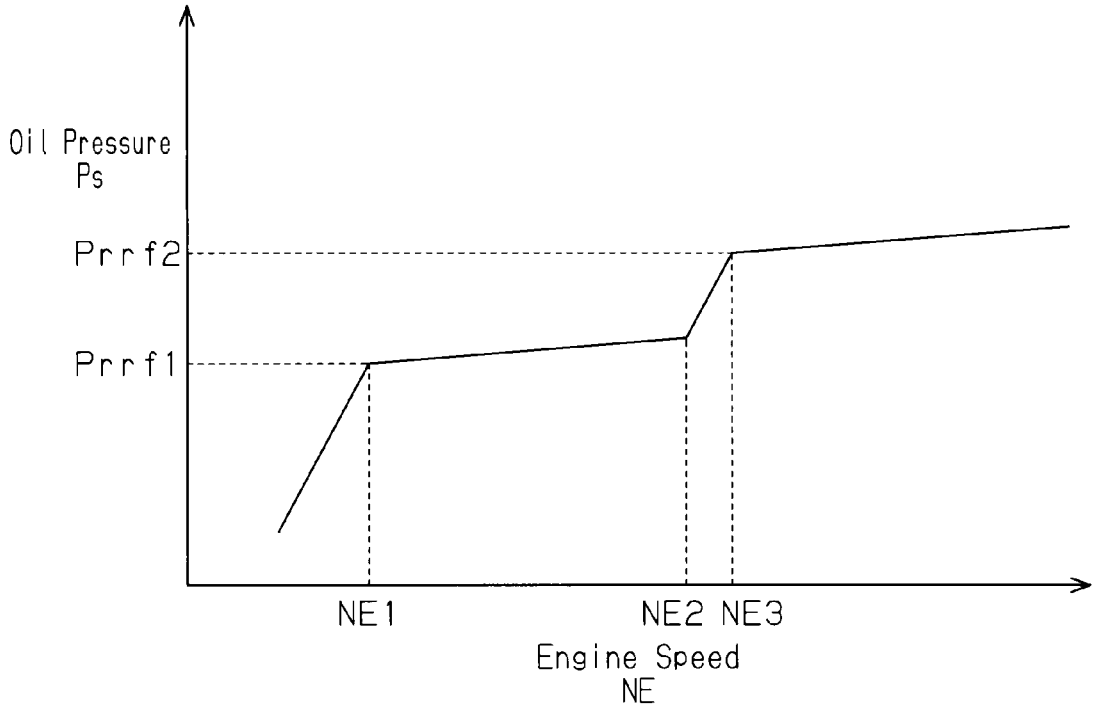
FIG. 4 is a graph representing the relationship between the engine speed and the pressure of oil in the internal combustion engine illustrated in FIG. 1.

With reference to FIG. 4, as the engine speed NE increases, the oil pressure Ps rises until the engine speed NE reaches a first engine speed NE1. When the oil pressure Ps becomes greater than or equal to the first pressure Prrf1, the relief valve 21 opens and the excessive oil in the portion of the main supply passage 11 downstream from the oil pump 14 escapes into the portion of the main supply passage 11 upstream from the oil pump 14 through the relief passage 16. Accordingly, although the oil pressure Ps increases as the engine speed NE rises, the increase rate of the oil pressure Ps becomes low compared to when the engine speed NE is smaller than or equal to the first engine speed NE1. Then, when the engine speed NE becomes equal to a second engine speed NE2 (NE2>NE1), the pressure level of the oil is switched from the low pressure level to the high pressure level by the pressure level switch mechanism 20, that is, the switch valve 29 is switched from the open state to the closed state. At this point, the oil pressure Ps is smaller than the second pressure Prrf2, so that the valve body 25 is maintained at a position above the position illustrated in FIG. 3(*b*). This closes the relief valve 21. Accordingly, until the engine speed NE rises to a third engine speed NE3 (NE3>NE1), the oil pressure Ps rises rapidly compared to when the relief valve 21 is open. Then, when the engine speed NE becomes equal to the third engine speed NE3 and the oil pressure Ps becomes greater than or equal to the second pressure Prrf2, the relief valve 21 opens. This causes the excessive oil in the portion of the main supply passage 11 downstream from the oil pump 14 to escape into the portion of the main supply passage 11 upstream from the oil pump 14 through the relief passage 16. Accordingly, although the oil pressure Ps increases as the engine speed NE rises, the increase rate of the engine speed NE becomes low compared to when the engine speed NE rises from the first engine speed NE1 to the second engine speed NE2.

Figure 5:
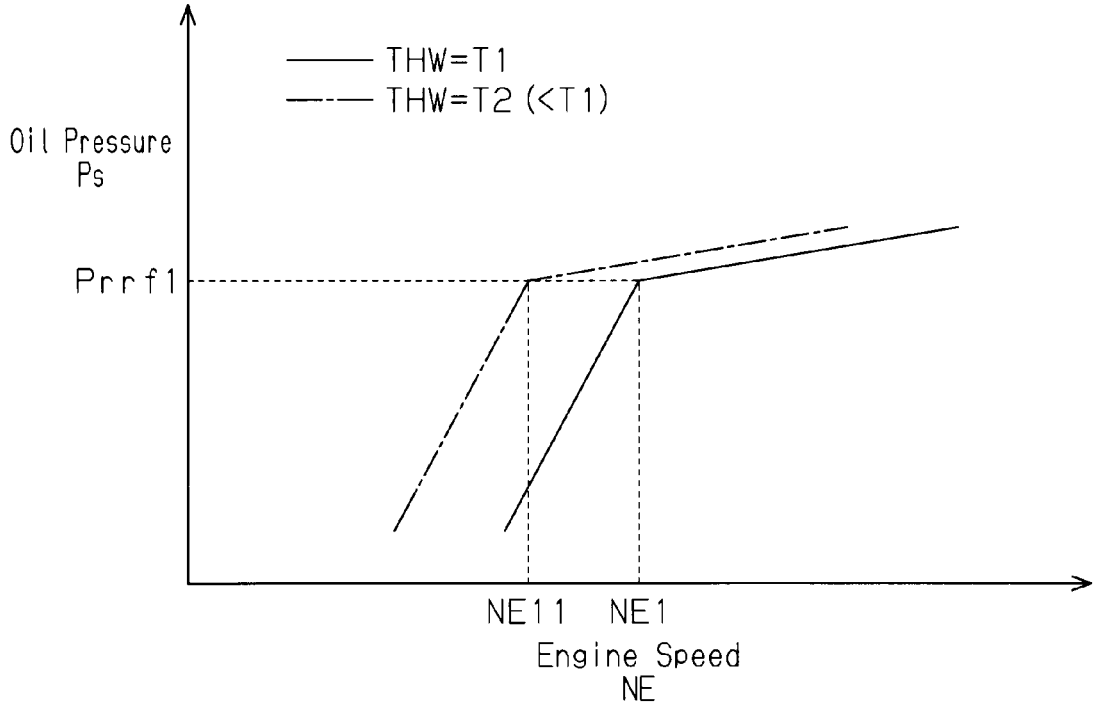
FIG. 5 is a graph representing the relationship between the engine speed and the pressure of the oil in the engine of FIG. 1 at different coolant temperatures.

The relationship between the coolant temperature THW and the oil pressure Ps will hereafter be described with reference to FIG. 5. In FIG. 5, change of the oil pressure Ps at the time when the coolant temperature THW is a first temperature T1 is represented by solid lines. The change of the oil pressure Ps at the time when the coolant temperature THW is a second temperature T2 (T2<T1) is represented by the single dotted chain lines.

The viscosity of oil decreases as the temperature of the oil increases. Accordingly, with reference to FIG. 5, for a common engine speed NE, the oil pressure Ps at the time when the coolant temperature THW is the first temperature T1, which is relatively high, is lower than the oil pressure Ps at the time when the coolant temperature THW is the second temperature T2, which is relatively low. As a result, if the coolant temperature THW is the first temperature T1, the oil pressure Ps becomes equal to the first pressure Prrf1 when the engine speed NE is the first engine speed NE1, thus opening the relief valve 21. However, if the coolant temperature THW is the second temperature T2, the oil pressure Ps becomes equal to the first pressure Prrf1 when the engine speed NE is an engine speed NE11 (NE11<NE1), which is smaller than the first engine speed NE1, thus opening the relief valve 21.

As has been described, the oil pressure Ps changes in correspondence with parameters representing the engine operating state, such as the engine speed NE or the coolant temperature THW. Accordingly, in order to obtain a desired oil pressure Ps, the engine operating state is determined through the electronic control unit 30 and the level of the pressure of the oil is switched as needed in accordance with the engine operating state. The switch timing of the pressure level of oil may be set, for example, with the intake air amount GA taken into consideration in addition to the aforementioned parameters.

The hydraulic control device for the internal combustion engine having the pressure level switch mechanism 20 may have a malfunction in which the switch valve 29 is held closed state or open, due to, for example, broken wires. Also, there may be a malfunction in which the movable member 24 cannot be moved to the first position or to the second position. Accordingly, there may be cases in which the pressure level of the oil cannot be switched, for example, to the high pressure level, and the engine cannot be operated stably when the engine is in such an operating state that oil under high pressure is necessary. Further, in other cases, it may be impossible to switch the oil pressure level to the low pressure level. In these cases, the oil pressure Ps becomes excessively high, thus reducing the fuel efficiency.

Accordingly, in the present embodiment, it is determined whether the pressure level switch mechanism 20 has a malfunction in the manner described below. Specifically, through the electronic control unit 30, a command signal instructing to switch the pressure level of oil to the high pressure level is output to the switch valve 29. After the command signal has been output, on condition that the oil pressure Ps is less than a malfunction determination value Pthx, it is determined that the pressure level switch mechanism 20 has a malfunction. In this manner, it is accurately determined that the pressure level switch mechanism 20 has a malfunction in which the pressure level of the oil cannot be switched to the high pressure level. Also, a command signal instructing to switch the pressure level of the oil to the low pressure level is output to the switch valve 29. After the command signal has been output, on condition that the oil pressure Ps detected by the oil pressure sensor 31 exceeds the malfunction determination value Pthx, it is determined that the pressure level switch mechanism 20 has a malfunction. In this manner, it is accurately determined that the pressure level switch mechanism 20 has a malfunction in which the pressure level of the oil cannot be switched to the low pressure level.

Next, setting of the malfunction determination value Pthx will be described with reference to FIG. 6.

Figure 6:
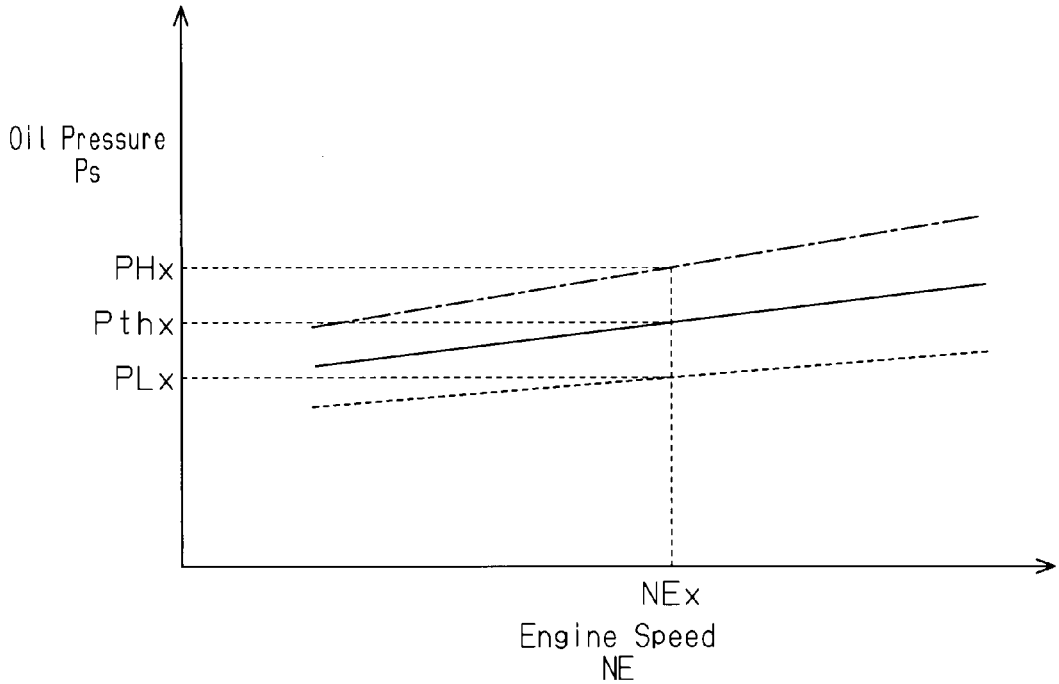
FIG. 6 is a graph representing setting of a malfunction determination value for the pressure level switch mechanism of FIG. 2.

FIG. 6 represents the relationship between the engine speed NE and the oil pressure Ps at a certain coolant temperature THW. In FIG. 6, an oil pressure PHx, which is expected when the oil pressure is at the high pressure level, is represented by the single dotted chain line. An oil pressure PLx, which is expected when the oil pressure is at the low pressure level, is represented by the broken line. Further, in the graph, the malfunction determination value Pthx is represented by the solid line.

With reference to FIG. 6, in determination whether the pressure level switch mechanism 20 has a malfunction, the malfunction determination value Pthx is set to an intermediate value ((PHx+PLx)/2) between the oil pressure PHx, which is expected when the oil pressure is at the high pressure level in the engine operating state at the time of the determination, and the low pressure level PLx, which is expected when the oil pressure is at the low pressure level in the engine operating state at the time of the determination. Specifically, the oil pressure Ps rises as the engine speed NE increases when the coolant temperature THW is constant. Accordingly, the malfunction determination value Pthx is set to a greater value as the engine speed NE becomes greater.

Figure 7:
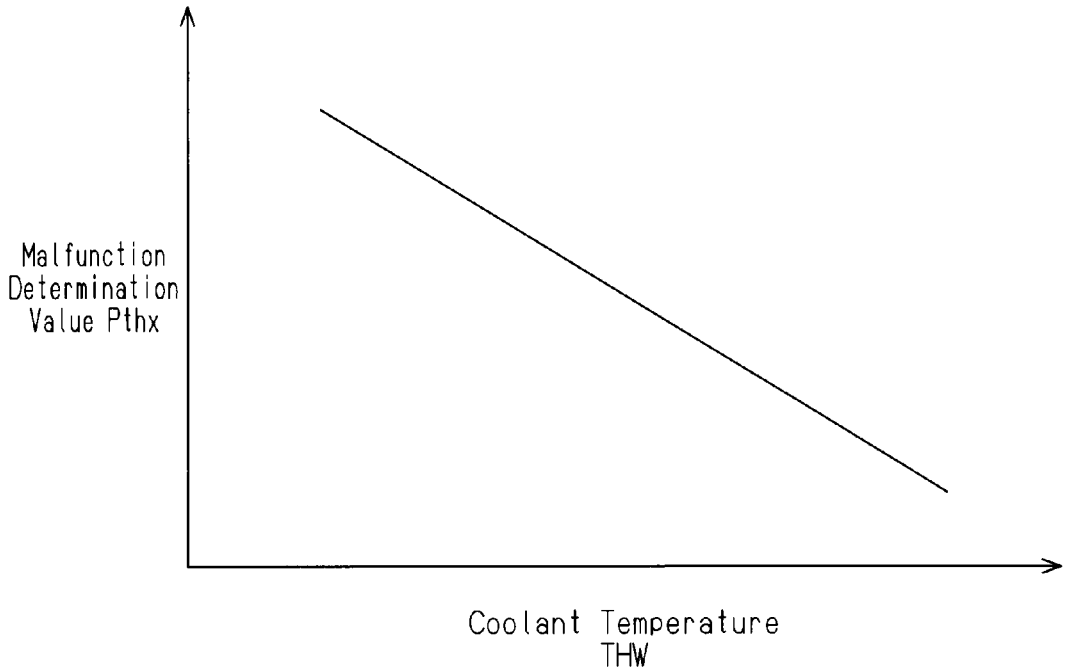
FIG. 7 is a graph representing setting of the malfunction determination value for the pressure level switch mechanism of FIG. 2.

As has been described, the oil pressure Ps becomes higher as the coolant temperature THW becomes lower when the engine speed NE is constant. Accordingly, as illustrated in FIG. 7, the lower the coolant temperature THW, the greater the malfunction determination value Pthx is set to be.

The oil pressure PHx and the oil pressure PLx, which are expected when the oil pressure is at the high pressure level and the low pressure level, respectively, at a certain coolant temperature THW, are obtained in advance, for example, through experiments. The oil pressures PHx and PLx are determined with reference to a map that uses the engine speed NE and the coolant temperature THW as parameters.

Figure 8:
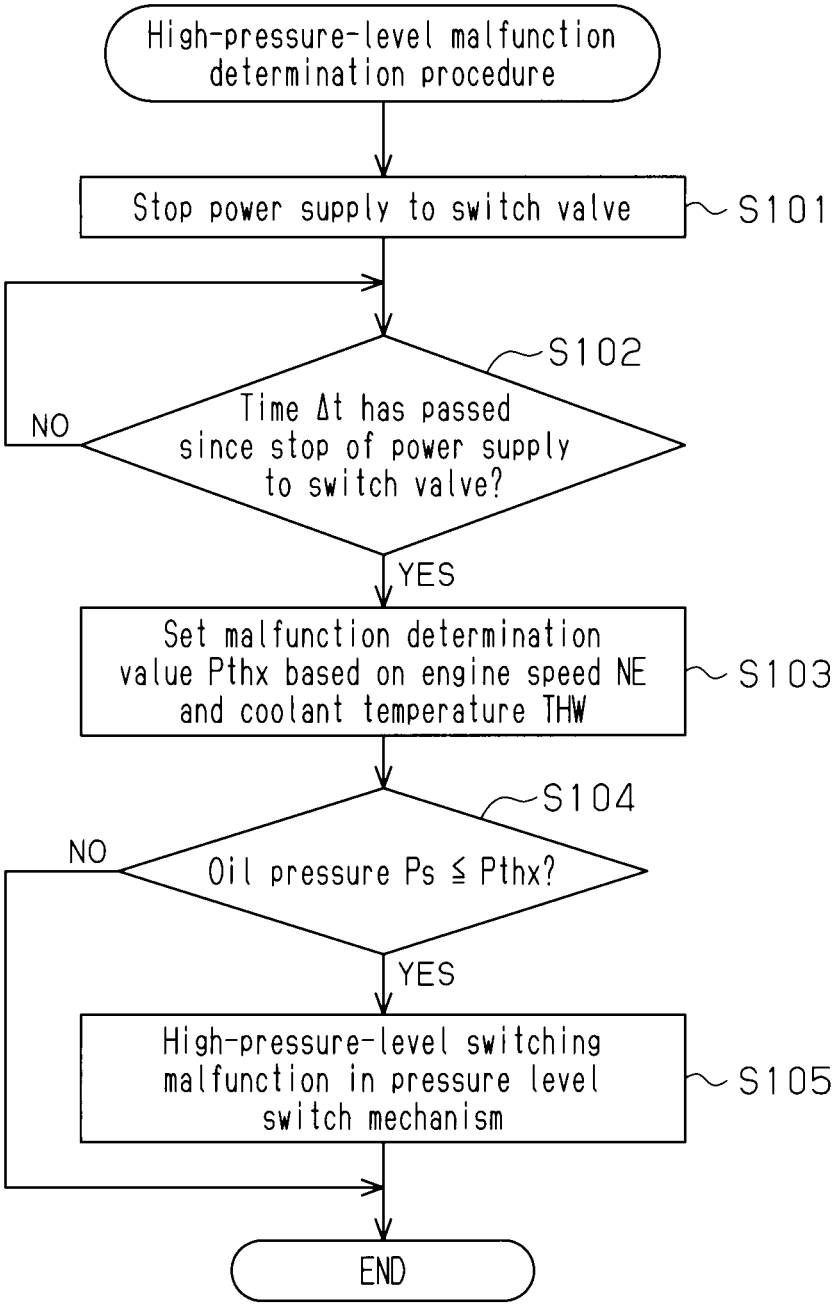
FIG. 8 is a flowchart representing a high-pressure-level switching malfunction determination procedure of the pressure level switch mechanism of FIG. 2.

A procedure for determining whether the pressure level switch mechanism 20 has a malfunction in which the oil pressure cannot be switched to the high pressure level (hereinafter, referred to as a high-pressure-level switching malfunction) will now be described with reference to FIG. 8. FIG. 8 is a flowchart representing the procedure. The series of procedure represented by the flowchart is executed by the electronic control unit 30 when the engine is operating and power is being supplied to the switch valve 29.

In the procedure, in step S101, the power supply to the switch valve 29 is stopped. Specifically, the command signal instructing to switch the pressure level of oil to the high pressure level is output to the switch valve 29. Then, the electronic control unit 30 determines whether a predetermined time Δt has elapsed since the power supply to the switch valve 29 was stopped (step S102). The time Δt is set longer than the time from when the power supply to the switch valve 29 is stopped to when the pressure level of the oil is switched to the high pressure level. When the time Δt has not yet elapsed (NO in step S102), determination of step S102 is repeated until the time Δt elapses. Subsequently, the electronic control unit 30 sets the malfunction determination value Pthx based on the engine speed NE and the coolant temperature THW both serving as a parameter indicating the engine operating state at the time when the time Δt has elapsed (step S103). Then, the electronic control unit 30 determines whether the current oil pressure Ps is smaller than or equal to the malfunction determination value Pthx (step S104). When the oil pressure Ps is smaller than or equal to the malfunction determination value Pthx (YES in step S104), the electronic control unit 30 determines that the pressure level switch mechanism 20 has the high-pressure-level switching malfunction and suspends the series of procedure. If it is determined that the current oil pressure Ps is greater than the malfunction determination value Pthx in step S104, the electronic control unit 30 suspends the procedure.

Figure 9:
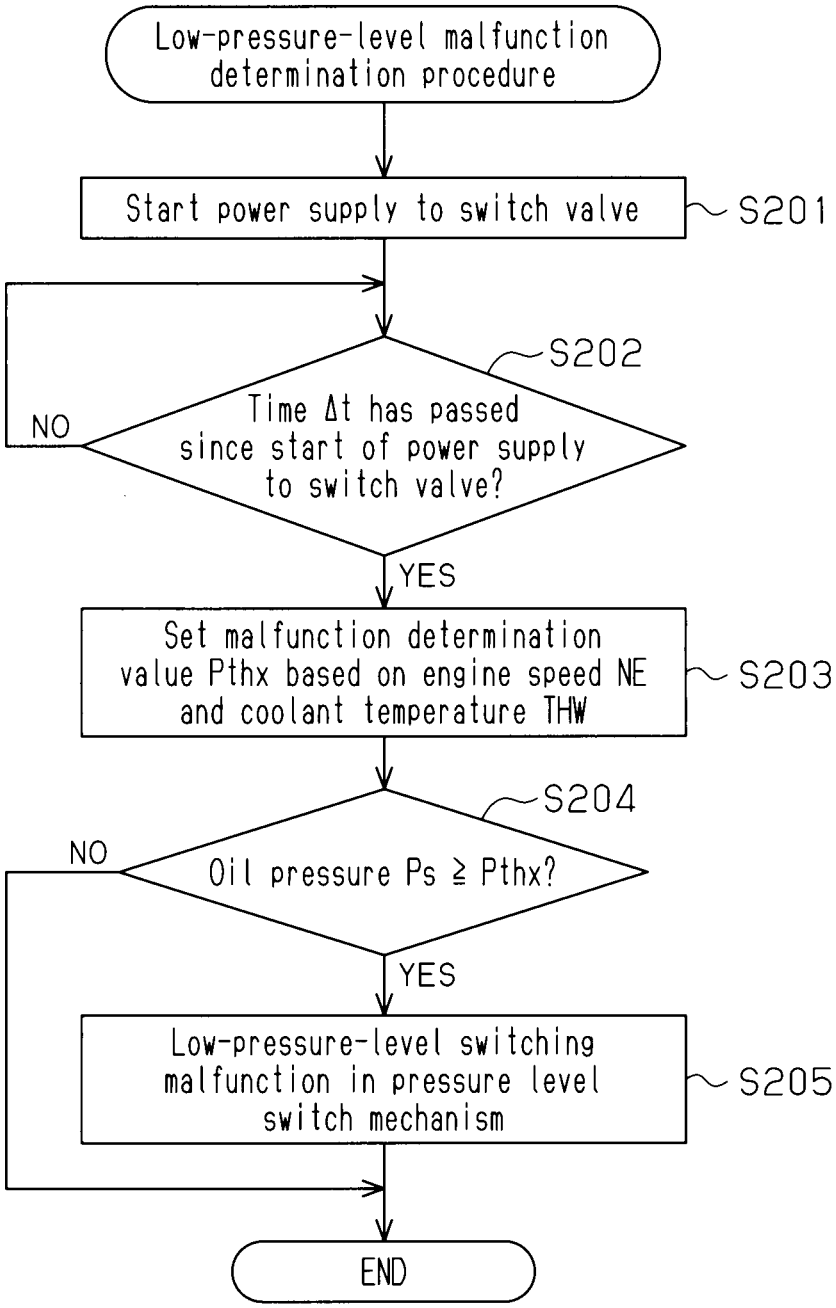
FIG. 9 is a flowchart representing a low-pressure-level switching malfunction determination procedure of the pressure level switch mechanism of FIG. 2.

Next, a procedure for determining whether the pressure level switch mechanism 20 has a malfunction in which the oil pressure cannot be switched to the low pressure level (hereinafter, referred to as a low-pressure-level switching malfunction) will be described with reference to FIG. 9. FIG. 9 is a flowchart representing the procedure. The series of procedure illustrated in FIG. 9 is performed by the electronic control unit 30 when the engine is operating and no power is supplied to the switch valve 29.

In the procedure, in step S201, the power supply to the switch valve 29 is started. Specifically, the electronic control unit 30 sends a command signal instructing to switch the oil pressure to the low pressure level to the switch valve 29. Then, the electronic control unit 30 determines whether the predetermined time At has elapsed since the power supply to the switch valve 29 was started (step S202). The time Δt is set longer than the time elapsed from when the power supply to the switch valve 29 is started to when the oil pressure is switched to the low pressure level. If the time Δt has not yet elapsed (NO in step S202), determination of step S202 is repeated until the time At elapses. Subsequently, the electronic control unit 30 sets the malfunction determination value Pthx based on the engine speed NE and the coolant temperature THW each serving as a parameter indicating the engine operating state at the time when the time At has elapsed (step S203). Then, the electronic control unit 30 determines whether the current oil pressure Ps is greater than or equal to the malfunction determination value Pthx (step S204). When the oil pressure Ps is greater than or equal to the malfunction determination value Pthx (YES in step S204), the electronic control unit 30 determines that the pressure level switch mechanism 20 has the low-pressure-level switching malfunction and suspends the series of procedure. If it is determined that the current oil pressure Ps is smaller than the malfunction determination value Pthx in step S204, the electronic control unit 30 suspends the procedure.

The present embodiment has the following advantages.

(1) The main supply passage 11 has the oil pressure sensor 31, which detects the oil pressure Ps that has been regulated by the pressure level switch mechanism 20. The electronic control unit 30 outputs a command signal instructing to switch the pressure level of oil to the high pressure level to the pressure level switch mechanism 20. Further, the electronic control unit 30 determines that the pressure level switch mechanism 20 has a malfunction on condition that, after the command signal has been output, the oil pressure Ps is lower than the malfunction determination value Pthx, which is set to the value between the value PHx, which is expected when the oil pressure is at the high pressure level in the engine operating state at the time, and the value PLx, which is expected when the oil pressure is at the low pressure level in the engine operating state at the time. This allows accurate determination that the pressure level switch mechanism 20 has a malfunction in which the pressure level of the oil cannot be switched to the high pressure level.

(2) In determination whether the pressure level switch mechanism 20 has a malfunction, the malfunction determination value Pthx is set to a value intermediate between the value PHx, which is expected when the oil pressure is at the high pressure level in the engine operating state at the time, and the value PLx, which is expected when the oil pressure is at the low pressure level in the engine operating state at the time. This facilitates the setting of the malfunction determination value Pthx.

(3) The electronic control unit 30 outputs the command signal instructing to switch the pressure level of the oil to the low pressure level to the pressure level switch mechanism 20. Also, the electronic control unit 30 determines that the pressure level switch mechanism 20 has a malfunction on condition that, after the command signal has been output, the oil pressure Ps detected by the oil pressure sensor 31 is greater than the malfunction determination value Pthx corresponding to the engine operating state at the time. This allows accurate determination that the pressure level switch mechanism 20 has a malfunction in which the pressure level of the oil cannot be switched to the low pressure level.

(4) The common malfunction determination value Pthx is used for determination of the high-pressure-level switching malfunction and determination of the low-pressure-level switching malfunction. Since it is unnecessary to set the malfunction determination value Pthx separately for the determinations of the two malfunctions, the configuration of the pressure level switch mechanism 20 related to the determinations of malfunctions is simplified compared to a case in which the malfunction determination value Pthx is set independently for the respective two malfunctions.

(5) The oil pump 14 is an engine-driven type. The electronic control unit 30 sets the malfunction determination value Pthx based on the engine speed NE. In the engine-driven oil pump 14, the oil pressure PHx, which is expected when the oil pressure is at the high pressure level, or the oil pressure PLx, which is expected when the oil pressure is at the low pressure level, becomes higher as the engine speed NE becomes greater. Accordingly, by setting the malfunction determination value Pthx, which is set to the value between the oil pressure PHx, which is expected when the oil pressure is at the high pressure level, and the oil pressure PLx, which is expected when the oil pressure is at the low pressure level based on the engine speed NE, the malfunction determination value Pthx is set further accurately.

(6) The electronic control unit 30 sets the malfunction determination value Pthx based on both of the engine speed NE and the coolant temperature THW. As the temperature of the oil becomes higher, the viscosity of the oil becomes smaller and the pressure of the oil becomes lower. Accordingly, when the engine speed NE is constant, the oil pressure PHx, which is expected when the oil pressure is at the high pressure level, or the oil pressure PLx, which is expected when the oil pressure is at the low pressure level, becomes smaller as the temperature of the oil becomes higher. Also, as the oil temperature becomes higher, the coolant temperature THW becomes higher. Accordingly, by setting the malfunction determination value Pthx, which is set to the value between the value PHx and the value PLx, based on both of the engine speed NE and the coolant temperature THW, the malfunction determination value Pthx is further accurately set.

The hydraulic control device for an internal combustion engine illustrated in the above-described embodiment may be modified to, for example, the forms described below.

The temperature of the oil may be detected directly and the malfunction determination value Pthx may be set based on the detected temperature of the oil. Further, any suitable parameter reflecting the engine temperature may be employed other than the coolant temperature THW and the oil temperature.

In order to set the malfunction determination value Pthx further accurately, it is desirable to set the malfunction determination value Pthx based on both of the engine speed NE and the engine temperature as in the above-described embodiment. However, if the above-described malfunction determination procedure is carried out only when the engine temperature is a predetermined value, which is, for example, the engine temperature after the engine has warmed up, the malfunction determination value Pthx may be set based only on the engine speed NE.

In order to set the malfunction determination value Pthx further accurately, it is desirable to set the malfunction determination value Pthx based on the engine speed NE, as in the above-described embodiment. However, if the malfunction determination procedure is performed only when, for example, the engine is in an idle state after the engine has warmed up, a fixed value may be employed as the malfunction determination value Pthx.

Although the above-described embodiment has been illustrated including the engine-driven oil pump, this type of oil pump is not indispensable in the hydraulic control device of the present embodiment. That is, the control device of the invention may employ an electric oil pump. Also in this case, as long as the oil pressure Ps, which is expected when the oil pressure is at the high pressure level or the low pressure level, exhibits the characteristic that such value Ps becomes higher as the engine speed NE becomes greater, the configuration with the electric oil pump has the same advantages as the advantages of the above embodiment.

Although the switch valve 29 is an electromagnetic valve in the above-described embodiment, the switch valve may be selectively opened and closed through hydraulic pressure or negative pressure.

In the above-described embodiment, the switch valve 29 switches the position of the movable member 24 between the first position and the second position in the directions in which the valve body 25 is selectively opened and closed. However, the means for switching the position of the movable member is not restricted to the switch valve 29. That is, the movable member may be directly driven in an electric or mechanical manner in order to switch the positions of the movable member.

The relief valve of the present invention is not restricted to the relief valve 21 illustrated in the above-described embodiment. Any suitable relief valve may be employed as long as the relief valve opens and permits some oil to escape when the pressure of the oil discharged by the oil pump becomes greater than or equal to the predetermined valve opening pressure Prrf. Further, any suitable switching section may be employed as long as the switching section switches the valve opening pressure between the first pressure Prrf1 corresponding to the low pressure level and the second pressure Prrf2 corresponding to the high pressure level.

In the above-described embodiment, the common malfunction determination value Pthx is used for the determination of the low-pressure-level switching malfunction and the determination of the high-pressure-level switching malfunction. However, according to the present invention, a high-pressure-level switching malfunction determination value and a low-pressure-level switching malfunction determination value are not restricted to the common malfunction determination value Pthx. Specifically, the high-pressure-level switching malfunction determination value and the low-pressure-level switching malfunction determination value may be set separately. In this case, the high-pressure-level switching malfunction determination value may be set to, for example, a value greater or smaller than the value intermediate between the oil pressure PHx, which is expected when the oil pressure is at the high pressure level in the engine operating state, and the oil pressure PLx, which is expected when the oil pressure is at the low pressure level in the engine operating state. Also, the low-pressure-level switching malfunction determination value may be set to, for example, a value greater or smaller than the value intermediate between the oil pressure PHx, which is expected when the oil pressure is at the high pressure level in the engine operating state, and the oil pressure PLx, which is expected when the oil pressure is at the low pressure level in the engine operating state.

In the above-described embodiment, both of the determination of the low-pressure-level switching malfunction and the determination of the high-pressure-level switching malfunction are performed. However, only one of these determinations may be carried out.

In the above-described embodiment, the pressure level switch mechanism having the relief valve and the switching section has been illustrated by way of example. The relief valve opens and permits some of oil that is discharged by the oil pump to escape when the pressure of the oil becomes greater than or equal to the predetermined valve opening pressure. The switching section switches the valve opening pressure between the predetermined first pressure corresponding to the low pressure level and the predetermined second pressure corresponding to the high pressure level, which is higher than the first pressure. However, the pressure level switch mechanism of the present invention is not restricted to this configuration and may be configured in such a manner that the oil pump is capable of directly switching the pressure of oil that is supplied to the components of the engine between the high pressure level and the low pressure level.

The invention claimed is:

1. A hydraulic control device for an internal combustion engine, the device having a pressure level switch mechanism that switches a pressure level of oil supplied to components of the engine between a high pressure level and a low pressure level, the hydraulic control device comprising:

a detecting section that detects the pressure of the oil that has been regulated by the pressure level switch mechanism; and a determining section that outputs a command signal instructing to switch the pressure level of the oil to the low pressure level to the pressure level switch mechanism and determines that the pressure level switch mechanism has a malfunction on condition that, after the command signal has been output, the pressure of the oil detected by the detecting section is greater than a low-pressure-level switching malfunction determination value, wherein the low-pressure-level switching malfunction determination value is set to a value between a value that is expected when the oil pressure is at the high pressure level in the engine operating state at the time of the determination and a value that is expected when the oil pressure is at the low pressure level in the engine operating state at the time of the determination.

2. A hydraulic control device for an internal combustion engine, the device having a pressure level switch mechanism that switches a pressure level of oil supplied to components of the engine between a high pressure level and a low pressure level, the hydraulic control device comprising:

a detecting section that detects the pressure of the oil that has been regulated by the pressure level switch mechanism; and a determining section that outputs a command signal instructing to switch the pressure level of the oil to the high pressure level to the pressure level switch mechanism and determines that the pressure level switch mechanism has a malfunction on condition that, after the command signal has been output, the pressure of the oil detected by the detecting section is smaller than a high-pressure-level switching malfunction determination value, wherein the high-pressure-level switching malfunction determination value is set to a value between a value that is expected when the oil pressure is at the high pressure level in the engine operating state at the time of the determination and a value that is expected when the oil pressure is at the low pressure level in the engine operating state at the time of the determination.

3. The hydraulic control device for an internal combustion engine according to claim 2, wherein the high-pressure-level switching malfunction determination value is set to a value intermediate between the value that is expected when the oil pressure is at the high pressure level in the engine operating state at the time of the determination and the value that is expected when the oil pressure is at the low pressure level in the engine operating state at the time of the determination.

4. The hydraulic control device for an internal combustion engine according to claim 2, wherein the determining section outputs a command signal instructing to switch the pressure level of the oil to the low pressure level to the pressure level switch mechanism, and determines that the pressure level switch mechanism has a malfunction on condition that, after the command signal has been output, the pressure of the oil detected by the detecting section is greater than a low-pressure-level switching malfunction determination value, and wherein the low-pressure-level switching malfunction determination value is set to a value between a value that is expected when the oil pressure is at the high pressure level in the engine operating state at the time of the determination and a value that is expected when the oil pressure is at the low pressure level in the engine operating state at the time of the determination.

5. The hydraulic control device for an internal combustion engine according to claim 4, wherein the low-pressure-level switching malfunction determination value is set to a value intermediate between the value that is expected when the oil pressure is at the high pressure level in the engine operating state at the time of the determination and the value that is expected when the oil pressure is at the low pressure level in the engine operating state at the time of the determination.

6. The hydraulic control device for an internal combustion engine according to claim 2, further comprising an oil pump that pressurizes and supplies the oil to the components of the engine, wherein the pressure level switch mechanism includes:

a relief valve that opens to permit some of the oil to escape when the pressure of the oil discharged by the oil pump is greater than or equal to a predetermined valve opening pressure; and a switching section that switches the valve opening pressure between a first pressure corresponding to the low pressure level and a second pressure that corresponds to the high pressure level and is greater than the first pressure.

7. The hydraulic control device for an internal combustion engine according to claim 6, further comprising a relief passage connecting a downstream side of the oil pump to an upstream side of the oil pump, wherein the relief valve includes:

an accommodation chamber that is provided in the relief passage and has an inlet-side opening and an outlet-side opening;

a valve body accommodated in the accommodation chamber, wherein the valve body is capable of changing the communication state between the inlet-side opening and the outlet-side opening and is urged in a valve opening direction by the pressure of the oil introduced through the inlet-side opening;

an urging member that urges the valve body in a valve closing direction; and a movable member arranged in the accommodation chamber to be movable along the opening and closing directions of the valve body, the movable member having a communication hole by which an opening position of the outlet-side opening is varied in the opening and closing directions of the valve body, wherein the switching section switches the position of the movable member in the opening and closing directions of the valve body between a first position corresponding to the first pressure and a second position that is located forward from the first position in the opening direction of the valve body and corresponds to the second pressure.

8. The hydraulic control device for an internal combustion engine according to claim 7, wherein the movable member is pressed in the closing direction of the valve body by a force produced by the pressure of the oil discharged by the oil pump, and wherein the switching section is an electromagnetic valve that switches a flow mode of the oil drawn to the movable member.

9. The hydraulic control device for an internal combustion engine according to claim 6, wherein the oil pump is an engine-driven type, and wherein the determining section sets the high-pressure-level switching malfunction determination value or the low-pressure-level switching malfunction determination value based on an engine speed.

10. The hydraulic control device for an internal combustion engine according to claim 9, wherein the determining section sets the high-pressure-level switching malfunction determination value or the low-pressure-level switching malfunction determination value based on both of the engine speed and an engine temperature.

* * * * *